United States Patent [19]

Vajda

[11] 4,357,003

[45] Nov. 2, 1982

[54] BLAST FURNACE CAST HOUSE POLLUTANT SUPPRESSION

[75] Inventor: Stephen Vajda, Pittsburgh, Pa.

[73] Assignee: Jones & Laughlin Steel Corporation, Pittsburgh, Pa.

[21] Appl. No.: 190,130

[22] Filed: Sep. 24, 1980

[51] Int. Cl.[3] ..... C21B 7/12; C21C 5/38; B22D 39/00

[52] U.S. Cl. ..... 266/158; 222/590; 222/591; 98/115 R; 98/115 VM; 266/45; 266/271

[58] Field of Search ..... 222/591, 590, 593, 603, 222/606, 607; 98/115 R, 115 VM; 220/88 B; 164/66, 68, 337; 75/53; 266/44, 45, 158, 271-273, 195, 196, 197, 207-211

[56] References Cited

U.S. PATENT DOCUMENTS

| | | | |
|---|---|---|---|
| 10,115 | 10/1853 | Woodruff | 75/53 |
| 1,091,330 | 3/1914 | Gostling | 75/53 |
| 2,932,564 | 4/1960 | Evans | 75/53 |
| 3,630,267 | 12/1971 | Hlinka et al. | 75/53 |
| 3,724,827 | 4/1973 | Dortenzo | 266/158 |
| 3,863,907 | 2/1975 | Pierson, Sr. et al. | 266/196 |
| 3,994,210 | 11/1976 | Davis | 98/115 R |
| 4,030,532 | 6/1977 | Tiberg | 249/199 |
| 4,111,405 | 9/1978 | Krelis | 266/158 |

FOREIGN PATENT DOCUMENTS

| | | | |
|---|---|---|---|
| 2157418 | 7/1974 | Fed. Rep. of Germany . | |
| 51-2882 | 1/1976 | Japan | 266/158 |
| 583162 | 12/1977 | U.S.S.R. | 266/197 |

OTHER PUBLICATIONS

McGannon, H. E., ed. *The Making, Shaping and Treating of Steel,* 8th edition, p. 407, U.S. Steel.

Translation of Japanese Patent 10.561/74, 4 pages, (3/12/74).

*Federal Register,* Vol. 46, No. 171, pp. 44171-44186, (9/3/81).

Translation of French Patent No. 71.13332, publication No. 2,133,285, issued Oct. 30, 1972, 3 pages of drawings.

Nicola, A. G.; "Blast Furnace Cast House Emission Control", *Iron and Steel Engineer,* pp. 33-39(8/79).

*Primary Examiner*—Michael L. Lewis

*Attorney, Agent, or Firm*—John Stelmah

[57] ABSTRACT

Method and apparatus for suppressing formation of pollutants in a blast furnace casting system by occluding oxidizing gases, including ambient air, from the molten iron and slag discharged from the furnace.

9 Claims, 5 Drawing Figures

BLAST FURNACE CAST HOUSE POLLUTANT SUPPRESSION

BACKGROUND OF THE INVENTION

1. Field of the Invention

The invention relates to the control of fume formation in steel mill blast furnace cast houses and more particularly to the suppression and mitigation of fumes from the iron troughs and the iron and the slag runners of the blast furnace casting system.

One of the most critical problems faced by the steel industry is the control of blast furnace cast house emissions. It is evident that the industry must develop new techniques for pollution controls if it is to obviate the substantial capital and operating costs associated with available technology for controlling blast furnace cast house emissions to levels required by governmental environmental protection agencies. Technology for emission reduction through gas cleaning exists and can be accomplished by a number of air pollution control devices which utilize exhaust and filtering equipment which collect and clean the fugitive air. However, it should be recognized that in the United States a great majority of the presently operating blast furnaces were built before 1960 and use the original cast houses in which there are spatial limitations toward retrofitting additional equipment such as pollution collection devices.

2. Description of Prior Art

The known prior art fume control systems which can be used in conjunction with steel mill blast furnaces are directed to the disposal of the fume after it has been generated.

U.S. Pat. No. 3,994,210 discloses method and apparatus by which jets in the form of moving curtains of air are utilized to control and direct the movement of fume from a fume-generating apparatus to an exhaust hood opening.

French Pat. No. 71.13332 is more specifically directed to the channeling of smoke emitted by molten cast iron as it is extracted from a blast furnace through the use of blower nozzles which laterally direct air curtains to limit lateral movement of the smoke and direct it to a ventilating head.

German Pat. No. 2,157,418 discloses an air cleaning device for the pouring platform of a blast furnace, which device comprises suction nozzles connected to a gas cleaner at the outlets of the filling hoppers and/or over the tap holes.

Additionally, there appears in the August 1979 issue of Iron and Steel Engineer, pp. 33–39, an article entitled "Blast Furnace Cast House Emission Control" by A. G. Nicola which sets forth the available technology for collecting the process fugitive emissions generated in the blast furnace cast house.

It is evident that most prior art fume pollution control systems are addressed to the ventilation or exhausting of fumes after they are formed, i.e., they are addressed to the effect rather than the cause.

SUMMARY OF THIS INVENTION

It is a primary object of this invention to provide method and apparatus to suppress and/or mitigate the formation of objectionable fume during the tapping of a blast furnace and the flow and pouring of iron therefrom.

In blast furnace case houses much fume is generated during the tapping of the furnace. It is believed that most of the fume is generated by the iron leaving the furnace contacting the oxygen of the ambient air and thereby forming iron oxide. Some of the fume is also generated by virtue of the sulfur in the molten iron and/or slag coming into contact with oxygen and forming sulfur dioxide.

This invention proposes to suppress the formation of obnoxious fume by providing method and apparatus for isolating much of the air from the molten metal and slag streams as they are discharged from the blast furnace and/or from the molten streams as they flow toward and to the collection vessels.

In the aforementioned Nicola article it is pointed out that basically, the fumes generated in the cast house are approximately 75% iron oxide and there is also outlined the reasons why the transfer of Japanese technology for cast house emission control on existing blast furnaces in the United States is not a simple matter. It further discloses that the primary emission control based upon the Japanese approach consists of capturing the cast house fumes at their source with close fitting hoods. It is very apparent that while hoods and other enclosures are described as being part of the Japanese approach such enclosures are employed as ductwork for directing the ventilating air with the entrained pollutants to collection devices such as baghouses.

Thus, the Nicola article points up the fact that prior cast house emission control is primarily concerned with the evacuation of fumes and emissions after they are formed. The present invention is contradistinctive because it is concerned with the suppression of the formation of the iron oxide fumes. The invention provides method and apparatus which exclude oxidizing gases, including the ambient air, during the tapping of the blast furnace from the area surrounding the tap hole, the iron trough and the iron and the slag runners. It will be recognized that it may not be possible to provide an absolutely air tight system, however, the formation of iron oxide and other pollutants formed by combining with oxygen is suppressed, primarily because there is no purposeful addition of air as an evacuation medium as there is in ventilating systems. However, it will be understood that an inert gas may be circulated over the molten streams from the blast furnace to occlude oxidizing gases and more particularly to restrain the infiltration of ambient air into the molten streams.

DESCRIPTION OF PREFERRED EMBODIMENTS

Figure 1:
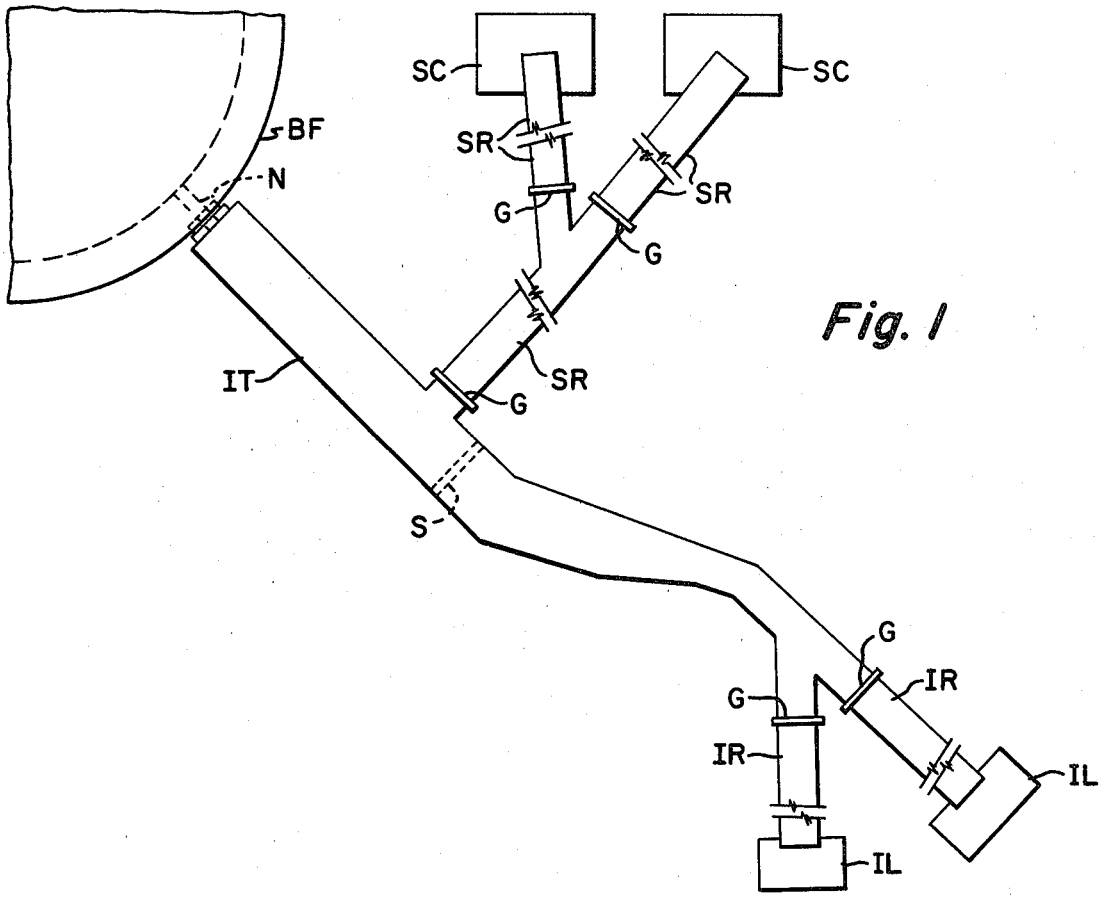
FIG. 1 is a schematic representation in plan view of a typical blast furnace and runner system.
Figure 2:
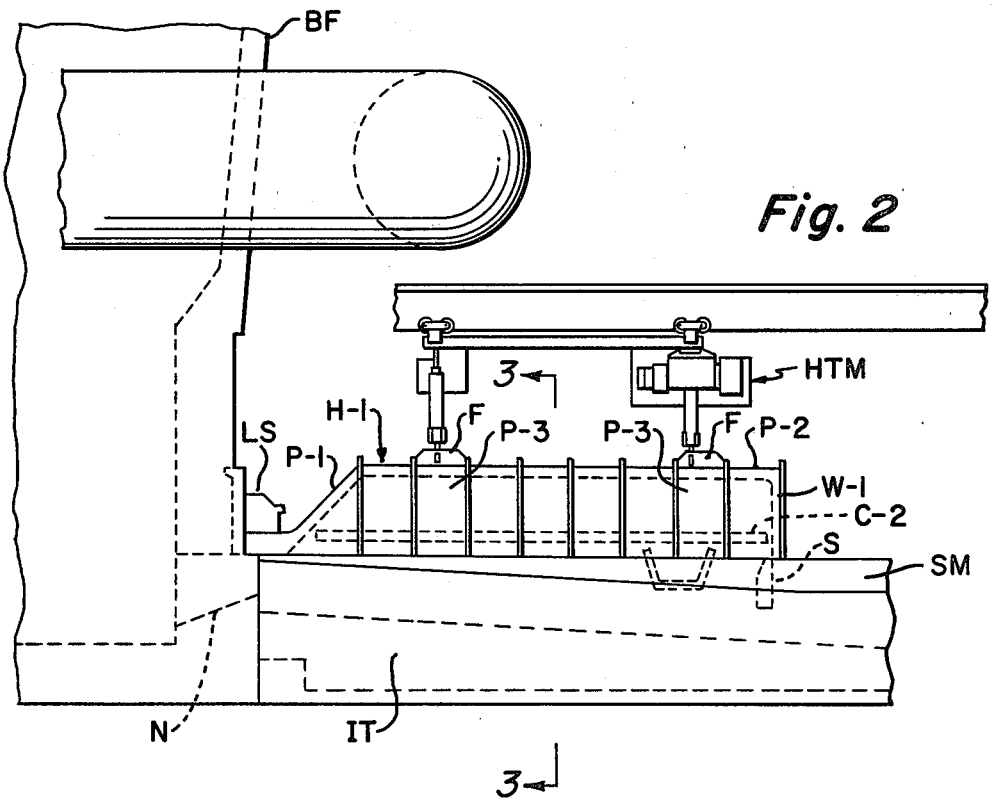
FIG. 2 is a side elevational view of fragmentary portion of a blast furnace and an iron trough together with an enclosure of this invention for the iron trough.
Figure 3:
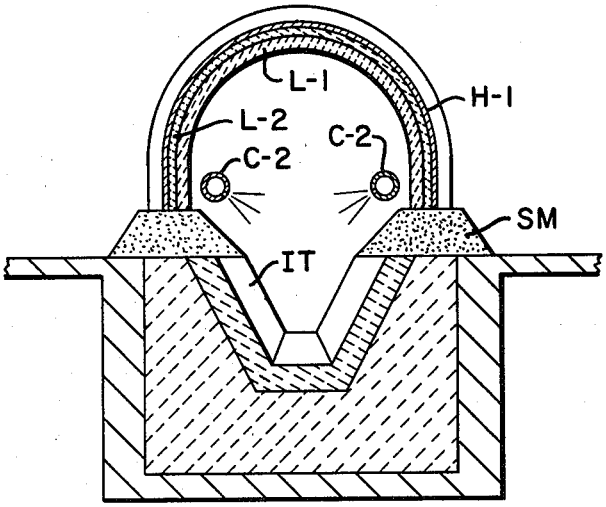
FIG. 3 is a cross-sectional view taken along line 3—3 of FIG. 2.
Figure 4:
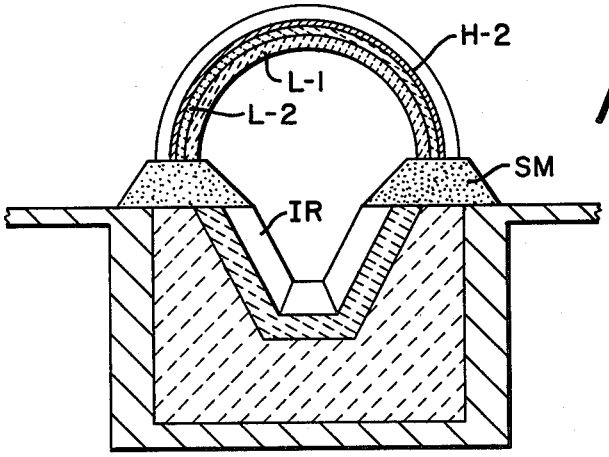
FIG. 4 is a transverse cross-sectional view of an enclosure for the iron and the slag runners.
Figure 5:
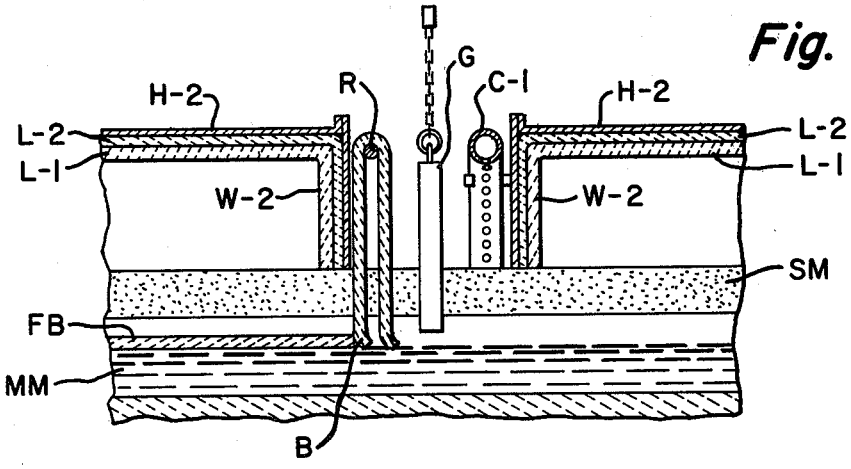
FIG. 5 is a fragmentary longitudinal sectional view of two adjacent enclosures of the type shown in FIG. 4 shown in conjunction with a runner gate and means for creating end curtains.

A typical embodiment of this invention is illustrated in FIG. 2 in conjunction with a blast furnace cast house system such as schematically illustrated in FIG. 1. It will be appreciated by those skilled in the art that there are many variations of the iron trough, iron runners, and slag runners used in connection with a blast furnace with which the principals of this invention can be applied.

The blast furnace and the discharge notch are generally designated by the reference characters BF and N, respectively. The molten material, comprising iron and slag, is intermittently tapped from the furnace BF through the notch N which extends downwardly from the outside of the furnace through the water cooled hearth jacket toward the hearth. The notch N is plugged after each cast with a clay mixture forced in the notch hole under pressure by means of a mud gun (not shown) which is latched onto latch support LS. As the notch N is opened during a tapping, the molten material flows out into a large trough IT, generally referred to as an iron trough. There is skimmer means S at the end of the trough IT which serves to skim off the slag from the molten material in the trough. The skimmer means S in some systems may include a dam (not shown) which may serve to help maintain the level of the molten material higher than the bottom of the skimmer plate. At the skimmer S there is an arrangement of gates G and runners SR to carry off the slag S to slag collector means SC, such as a slag pot or a large pit. The iron flowing under the skimmer plate runs down troughs IR, commonly referred to as iron runners, which are also fitted with gates G to selectively divert the flow to each of several iron ladles IL. At the end of a cast or tapping, the mud gun is placed in position to plug the notch hole with clay. It is at this stage that special provision must be made to handle the section of enclosure surrounding the tap or notch hole in order to provide access by the mud gun to the notch.

As indicated above, the present invention relates to the provision of method and apparatus for occluding the ambient air from the surface of the molten stream as it flows from the blast furnace toward the iron ladle and the slag collection means. In accordance with a preferred embodiment of the invention occlusion means in the form of hoods H are provided to minimize the amount of ambient air which contacts the molten streams and without the addition of any air within the hoods as is the practice in forced ventilating hoods. The various types of hoods are further designated by numeral suffixes.

There is provided immediately adjacent to the blast furnace BF a hood H-1 which covers the iron trough. It is preferred to provide separate hoisting and transport mechanism, generally designated by the reference HTM, for lifting and moving the hood H-1 away from the tap hole in preparation for the tapping and plugging procedures. The cross-sectional configuration of hood H-1 is preferably in the form of an inverted U. The hood H-1 is comprised of several panel sections P which are joined together, such as by welding the upturned edges of the outer casings which form stiffening flanges. The section P-1 has a slanted top tapered toward the blast furnace and terminating in a nose portion to provide an end closure which will also accommodate positioning of the hood H-1 beneath the clay gun support LS. The opposite end section P-2 has a vertical wall portion W-1 to likewise provide an end closure. Each of the sections P are provided with insulation to protect the metal cover. Preferably, there are provided two layers of insulation anchored to the cover by metal clips; the innermost layer L-1 in respect to the trough, being of the non-consumable refractory type and the outermost layer L-2, in respect to the trough, having higher insulating quality than the layer L-1. Each of the layers L-1 and L-2 may be applied as by gunning, at the site.

Some of the sections, such as section P-3, are provided with upstanding flanges F which define holes for inserting the fastening means such as hooks of the hoisting and transport mechanism HTM.

The hoods H-2 are provided to enclose the iron runners IR and the slag runners SR. The hoods H-2 are similar in construction as hood H-1 except that they are smaller in their cross-sectional configurations. Also, in a preferred form, the hoods H-2 include the end vertical wall closures W-2. This end wall W-2 may be supplemented with a flexible blanket of insulating material B draped over support rod R or a curtain of inert gas through conduit means such as pipe C-1. Preferably, pipe C-1 is formed to correspond to the end cross-section of hood H-2, i.e., it is generally semi-circular in shape and has a plurality of nozzles for discharging the inert gas and creating the vertical curtain or blanket for occluding the ambient air. The pipe is suitably attached to line supply means through releasable coupling means. The reason for preferring the inert gas curtain type of end seal is that the height of the molten material in the runners will vary and hence it would be impossible to provide a mechanical seal which would be self-adjusting to compensate for the variations in the height of the material flow.

Alternatively and/or additionally, inert gas supply means may be provided within the hoods H in the form of conduit C-2 which extend longitudinally of and on either or both sides of and within the hoods H. The hoods H would thus serve to contain the inert gases and create a blanket over the surface of the molten material. In a less preferred embodiment the inert gases would be used to create a blanket in the absence of the confining hoods H through the use of pipe means extending longitudinally of each side of the troughs and runners.

Alternatively and/or additionally, an inert non-combustible material such as vermiculite may be provided on top of the iron or slag to create a floating blanket FB over the surface of the molten material MM. This floating blanket would be kept in position by the use of suitable means, e.g., a suspended carbon skimmer which extends just below the surface of the molten material.

Also there may be provided between the hoods H and the tops of the troughs and runners yieldable non-combustible sealing means SM, such as sand or refractory fiber felt.

Thus, unlike the prior art systems which rely upon evacuating the cast house air with entrapped emissions, the present invention is directed toward restraining the formation of the objectionable pollutants. Through the use of the method and apparatus of this invention the occlusion of the ambient cast house air from the surface of the molten iron and slag is enhanced and the formation of iron oxides is suppressed. A further advantage of the present invention is one of confining the natural kish which is formed on the surface of the molten iron. A still further and important advantage is that the "hot metal", molten iron, is delivered to the iron ladles at a relatively high temperature since there are no massive air currents moving across the surface of the molten iron in the troughs as there are in air ventilating systems. The hotter molten metal and iron runners result in less iron skull formation in the runners and a concomitant increase in iron yield. Still further, the invention provides method and apparatus which may be readily and safely embodied in existing blast furnace cast house systems and at relatively little cost as compared to pollutant collection systems which require additional equipment and space for the ducts and filter baghouses, which collection systems also pose health and safety hazards because of the problems encountered in the disposal of the collected dust. A further disadvantage of such collection systems is that they consume considerable energy as compared to the system of this invention.

What is claimed is:

1. A method of suppressing formation of pollutants in an ironmaking blast furnace system having an iron trough, an iron runner, and a slag runner, each of which is adapted to carry a molten stream, which method comprises:

occluding oxidizing gases, including ambient air, from at least said tap hole and said iron trough extending from said tap hole by covering said tap hole and said iron trough with hood means having no ventilating means said hood means arranged in relation to said taphole and said iron trough in a manner capable of preventing ventilation of said hood means.

2. The method as described in claim 1, wherein:

open-end hood means is used and a vertical blanket of inert gas is created at an open-end to occlude entry of ambient air therethrough into said hood means.

3. The method as described in claim 1, wherein:

a plurality of hood means are used and there exists an uncovered spacing between said hood means, and there is created a blanket of insulation over said spacing which occludes ambient air from the molten stream within said spacing.

4. The method as described in claim 1, wherein:

open-end hoods means is used and a vertical blanket of insulation occludes entry of ambient air into said hood means through an open-end thereof.

5. In a blast furnace system including a furnace having a tap hole, said system having an iron trough, an iron runner, and a slag runner, each of which is adapted to carry a molten stream, the improvement which comprises: hood cover means for at least said tap hole and said iron trough, said hood cover means containing no ventilating means and arranged in relation to said taphold and said iron trough in a manner capable of preventing ventilation of said hood cover means and occluding oxidizing gases from said tap hole and from said iron trough extending from said tap hole.

6. The improvement as described in claim 5, which further comprises: hood cover means for at least one said iron runner and said slag runner.

7. The improvement as described in claim 5, wherein:

said hood cover means is of an open-end type and which further comprises means for providing a vertical blanket of inert gas at an open-end of said hood cover means for occluding ambient air through said open-end.

8. The improvement as described in claim 6, which comprises:

a plurality of spaced-apart hood cover means; and a blanket of gas occlusive insulating material covering at least a portion of the space between said spaced-apart hood cover means.

9. In a blast furnace system comprising clay gun latch support means and an iron trough, the improvement comprising:

transportable hood cover means for said iron trough, which hood cover means occludes oxidizing gases from therein and which includes a top portion tapering toward the blast furnace and terminating in a nose portion defining an end closure which accommodates positioning of said hood cover means beneath said clay gun latch support.

* * * * *

UNITED STATES PATENT OFFICE

CERTIFICATE OF CORRECTION

PATENT NO. : 4357003

DATED : November 2, 1982

INVENTOR(S) : Stephen Vajda

It is certified that error appears in the above-identified patent and that said Letters Patent are hereby corrected as shown below:

In line 2 of claim 1 insert --a tap hole,-- after "having".

In lines 7 and 8 of claim 5, change "ta-phold" to --tap hole--.

Signed and Sealed this

*Nineteenth* Day of *April 1983*

[SEAL]

*Attest:*

GERALD J. MOSSINGHOFF

*Attesting Officer*

*Commissioner of Patents and Trademarks*